US005825974A

United States Patent [19]

Hutton et al.

[11] Patent Number: 5,825,974

[45] Date of Patent: Oct. 20, 1998

[54] ELECTRIC FAN HEATER WITH SWITCHABLE SERIES/PARALLEL HEATING ELEMENTS

[75] Inventors: Duncan N. Hutton; Richard Hingley, both of St. Leonards on Sea, England

[73] Assignee: U.S. Philips Corporation, New York, N.Y.

[21] Appl. No.: 366,148

[22] Filed: Dec. 28, 1994

[30] Foreign Application Priority Data

Dec. 31, 1993 [GB] United Kingdom ..... 9326586

[51] Int. Cl.[6] ..... F24H 3/02

[52] U.S. Cl. ..... 392/360; 219/480; 219/508

[58] Field of Search ..... 392/360, 361, 392/363–374, 379, 380–385; 219/480, 508; 34/268, 269, 283, 96–101, 553, 554

[56] References Cited

U.S. PATENT DOCUMENTS

| | | | |
|---|---|---|---|
| 1,574,343 | 2/1926 | Frederics | 392/373 |
| 1,607,195 | 11/1926 | Gross | 392/379 |
| 2,552,470 | 5/1951 | Wahlberg . | |
| 2,647,198 | 7/1953 | Lautner | 392/363 |
| 4,110,600 | 8/1978 | Spotts et al. | 392/368 |
| 4,912,300 | 3/1990 | Hennuy et al. | 392/365 |

FOREIGN PATENT DOCUMENTS

| | | | |
|---|---|---|---|
| 2456489 | 12/1980 | France | 392/379 |
| 649754 | 12/1992 | France | 392/383 |
| 1122644 | 1/1962 | Germany | 392/360 |
| 162330 | 8/1933 | Switzerland | 392/360 |
| 1207472 | 10/1970 | United Kingdom | 392/360 |

*Primary Examiner*—John A. Jeffery
*Attorney, Agent, or Firm*—Bernard Franzblau

[57] ABSTRACT

An electrical heating apparatus, for example, a fan heater, comprises at least an electrical heating element (14) and a motor (14) for driving a fan. The apparatus also comprises a switch device arranged to provide the apparatus with two operating modes. In the first mode the heating element and the motor are connected in parallel, and in the second mode the heating element and the motor are connected in series. The first mode provides a relatively high heat output and/or high airflow to distribute the heat quickly. The second mode provides quieter operation at a similar or lower output power level, for example, to maintain a given temperature while causing less disturbance to people in the vicinity of the fan heater. A further heating element may be arranged in parallel with the motor in the second mode of operation so as to provide a potential divider for supplying the motor.

14 Claims, 4 Drawing Sheets

| M | 40 | 42 | 44 | 46 | 48 | 50 |
|---|---|---|---|---|---|---|
| 1 | 1 | X | 0 | X | 1 | 0 |
| 2 | 0 | 1 | 0 | X | 1 | 1 |
| 3 | 0 | 1 | 1 | 0 | 1 | 0 |
| 4 | 0 | 1 | 1 | 0 | 1 | 1 |
| 5 | 1 | 0 | 1 | 0 | 1 | 1 |
| 6 | 0 | 1 | 0 | 1 | 0 | 1 |

FIG. 4

ELECTRIC FAN HEATER WITH SWITCHABLE SERIES/PARALLEL HEATING ELEMENTS

FIELD OF THE INVENTION

This invention relates to an electrical heating apparatus having a first and a second heating mode with particular, but not exclusive, application to a domestic fan heater.

BACKGROUND OF THE INVENTION

Fan heaters have been known for some time which provide rapid heating of a confined space by providing a stream of air blown over one or more electrical heating elements. The intensity of the heating effect may be adjusted by altering the position of one or more switches which alter the number of heating elements which are currently connected to an electrical supply.

A difficulty which arises with known designs of fan heater is a problem in sustaining a maintenance level of heating in an area which is close to a desired temperature, whether or not this area has already been subjected to a period of fast heating by the fan heater. Thermostats have been provided in fan heaters to switch the heater on or off as the area in which it is located becomes colder and warmer, respectively, but the fast heating provided by the fan heater often causes frequent switching on and off of the heater and a significant distraction to people within both the blowing range and hearing of the heater.

SUMMARY OF THE INVENTION

It is an object of the present invention to provide a heating apparatus such as a fan heater which provides less of a disturbance to those people in its vicinity.

According to the present invention there is provided a heating apparatus comprising an electrical heating element and a fan arranged so as to drive air past the electrical heating element when the fan rotates, the fan being coupled to an electric motor, characterised by switching means having at least a first mode in which the electrical heating element and the electric motor are connected in parallel and a second mode in which the electrical heating element and the electric motor are connected in series.

A heating apparatus in accordance with the present invention thus provides a first operating mode in which both the heating element and the fan motor may be connected across the full voltage of whichever electrical supply is being used and a second operating mode in which the heating element and the fan motor may be connected in series across the electrical supply. In the second mode the voltage applied to both the heating element and the fan motor is clearly reduced with respect to the first mode. Consequently, both the heat output of the apparatus and the noise generated by the motor-driven fan will be reduced to produce a slower heating effect with less noise. This is obtained without any significant level of complexity as might result from using electronic control arrangements.

When the current drawn by the motor is low compared with that drawn by the heating element, it may be preferable to connect a further heating element in parallel with the motor to provide a potential divider arrangement. This may be extended to provide a number of series/parallel arrangements with different heat output powers and fan speeds.

A heating apparatus in accordance with the present invention may further comprise thermostat means arranged to switch the apparatus on and off in accordance with the surrounding temperature. In addition or as an alternative to thermostat means, further thermostat means may be provided to switch the apparatus from the first mode to the second mode and vice versa in accordance with the surrounding temperature. The thermostat means may be adjustable for temperature in known manner.

The heating apparatus may comprise switching means having a mode in which the electric motor is off in order to provide convector heater operation.

BRIEF DESCRIPTION OF THE DRAWINGS

The present invention will now be described in greater detail with reference to the following drawings, in which FIG. 4 shows a table which gives the positions of switches in the embodiment shown in FIG. 3 for different modes of operation.

DESCRIPTION OF THE PREFERRED EMBODIMENTS

Figure 1:
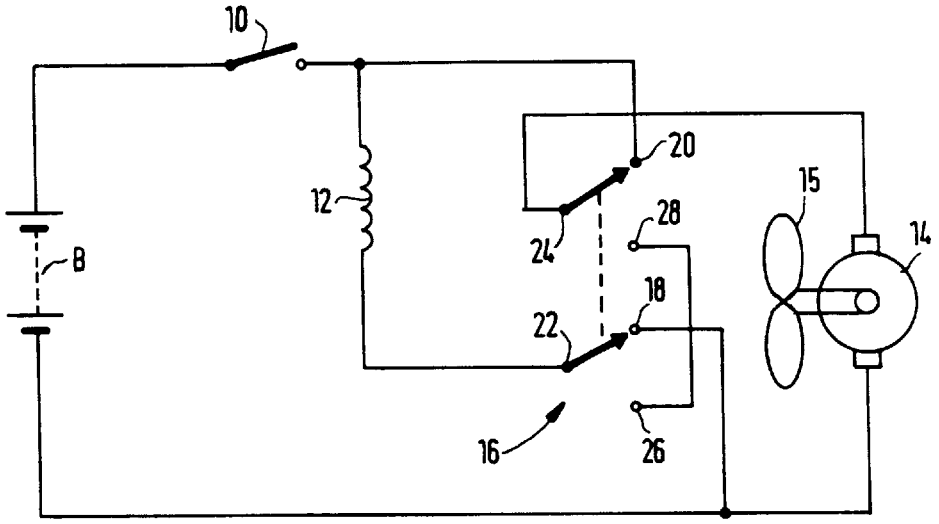
FIG. 1 shows a schematic diagram of a first embodiment of the present invention.

FIG. 1 shows an electrical heating apparatus connected to a battery B. The positive terminal of the battery is connected to a first contact of an on/off switch 10. A second contact of the on/off switch 10 is connected to a contact 20 of a double pole, double throw switch 16 and to a first end of an electrical heating element 12, for example, a 2 kW heating element. A second end of the element 12 is connected to a contact 22 of the switch 16. The negative terminal of the battery is connected to the terminal 18 of the switch 16 and to a first terminal of a motor 14. The motor 14 is connected to drive a fan 15 which is arranged to blow air past the element 12. A second terminal of the motor 14 is connected to a terminal 24 of the switch 16. Terminals 26 and 28 of the switch 16 are connected together. The switch 16 has two positions, a first position in which contact 22 is connected to contact 18 and contact 24 is connected to contact 20, and a second position in which contact 22 is connected to contact 26 and contact 24 is connected to contact 28.

In operation the electrical heating apparatus is switched on using the switch 10 and has two modes of operation. A first mode of operation provides the full battery voltage across both the element 12 and the motor 14 (switch 16 in the first position) and a second mode of operation in which the element 12 and the motor 14 are connected in series across the battery (switch 16 in the second position). In the first mode the second end of the element 12 is connected to the negative terminal of the battery via terminals 22 and 18 of the switch 16 and the second terminal of the motor 14 is connected to the positive terminal of the battery via terminals 20 and 24 of the switch 16. In the second mode the second end of the element 12 is connected via terminals 22, 26, 28 and 24 of the switch 16 to the second terminal of the motor 14. The first mode thus provides a first heat output and fan speed and the second mode provides a lower heat output and fan speed. The changeover between the two modes may be arranged to depend on temperature by making the switch 16 a thermostatic switch.

Figure 2:
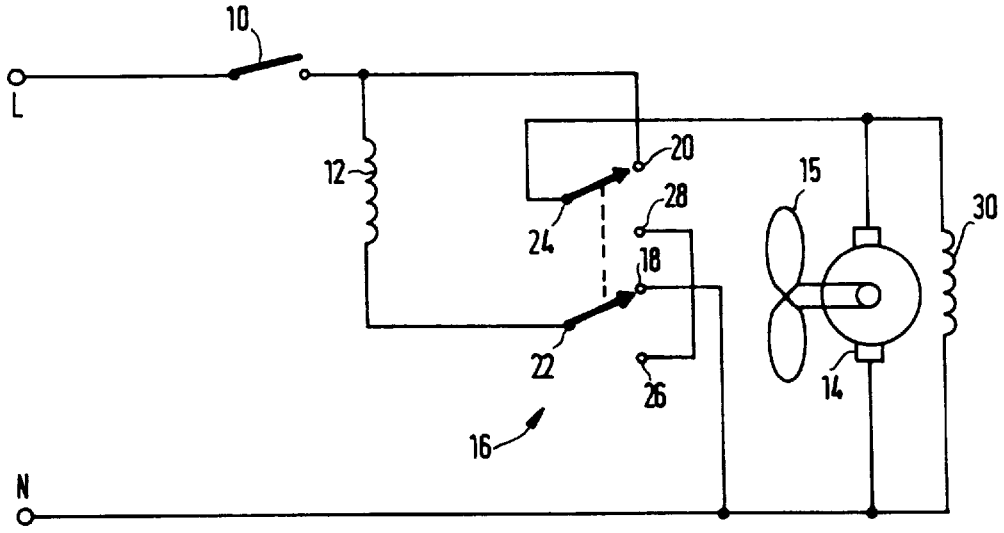
FIG. 2 shows a schematic diagram of a variation of the first embodiment.

FIG. 2 shows a variation of the heating apparatus of FIG. 1. The battery B has been replaced by live (L) and neutral (N) terminals of a mains supply and a further electrical heating element 30 has been added in parallel with the motor 14. This arrangement is applicable to cases where the current drawn by the motor is small in comparison with that drawn by the heating element. If element 12 is a 2 kW element and element 30 is a 1 kW element (when connected directly across the mains supply) then the apparatus provides a second mode of operation in which the motor is connected across approximately two thirds of the mains supply voltage. The motor speed is reduced and the total heat output is less than 1 kW. To cause the motor to run even more slowly and hence quietly the location of the two elements 12, 30 could be reversed, provided that sufficient air flow is generated to prevent the heating apparatus from overheating. In the first mode of operation of the apparatus of FIG. 2 both of the heating elements 12, 30 are connected across the full mains supply to provide a total of 3 kW heat output. This may be altered if desired by providing a separate switch for heating element 30.

Figure 3:
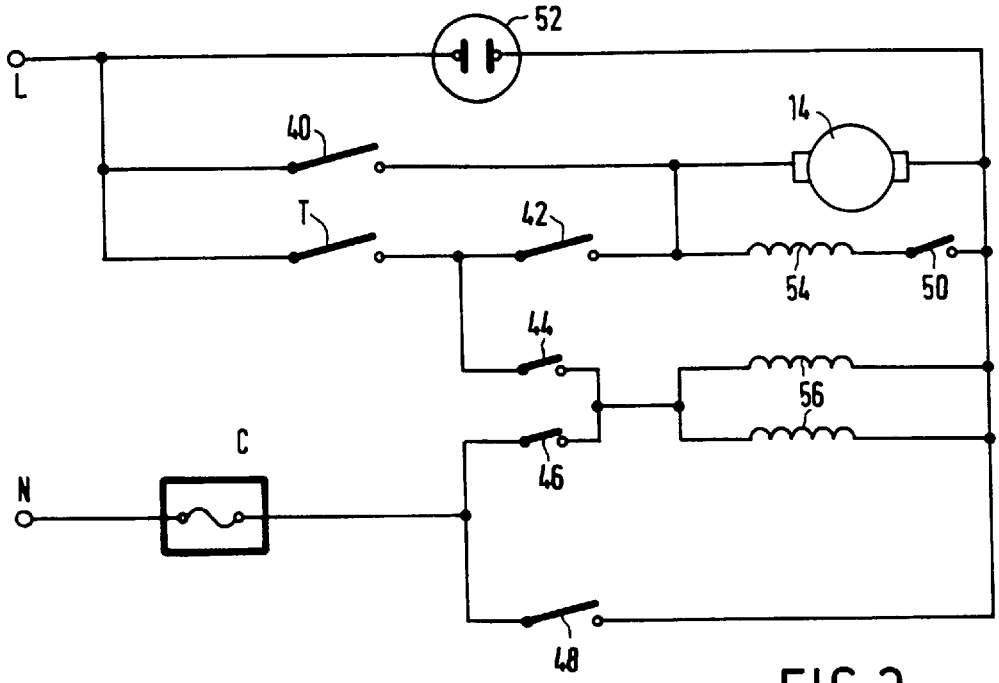
FIG. 3 shows a schematic diagram of a second embodiment of the present invention.

FIG. 3 shows a schematic diagram of a more sophisticated heating apparatus, in this case a fan heater, in accordance with the invention. A live terminal L of the mains supply is connected to a first terminal of a neon indicator 52, to a first terminal of a switch 40 and to a first terminal of a thermostat T. A second terminal of the switch 40 is connected to a first terminal of a motor 14 which drives a fan (not shown) arranged to blow air over electrical heating elements 54 and 56. A second terminal of the thermostat T is connected to a first terminal of a switch 42 and to the first terminal of a switch 44. A second terminal of the switch 42 is connected to the first terminal of the motor 14 and to a first terminal of a 1 kilowatt heating element 54. A second terminal of the neon indicator 52 is connected to a second terminal of the motor 14, to the second terminal of a switch 50, to the second terminal of a 2 kilowatt heating element 56 (shown here as a pair of 1 kW heating elements) and to a second terminal of a switch 48. A second terminal of the element 54 is connected to a first terminal of the switch 50. A first terminal of the element 56 is connected to a second terminal of the switch 44 and to a second terminal of a switch 46. A first terminal of the switch 46 is connected to a first terminal of the switch 48 and to the neutral terminal N of the mains supply via a thermal cutout C.

Figure 6:
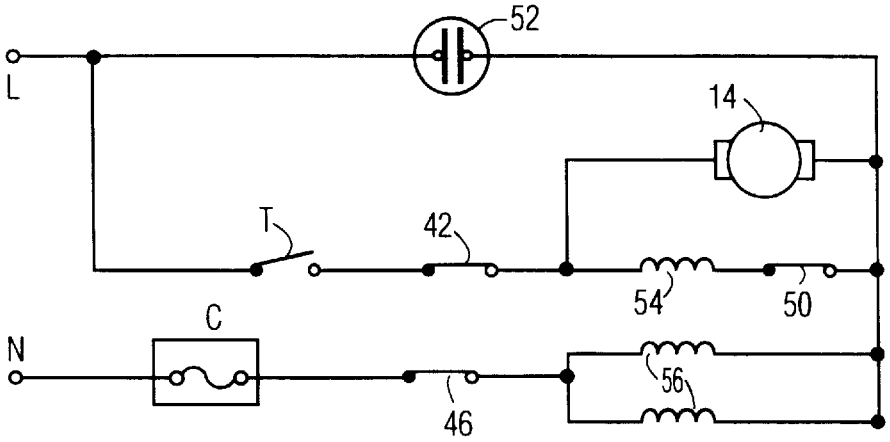
FIG. 6 shows a schematic diagram illustrating the heating mode in Line 6 of FIG. 4 for the embodiment of FIG. 3.
Figure 7:
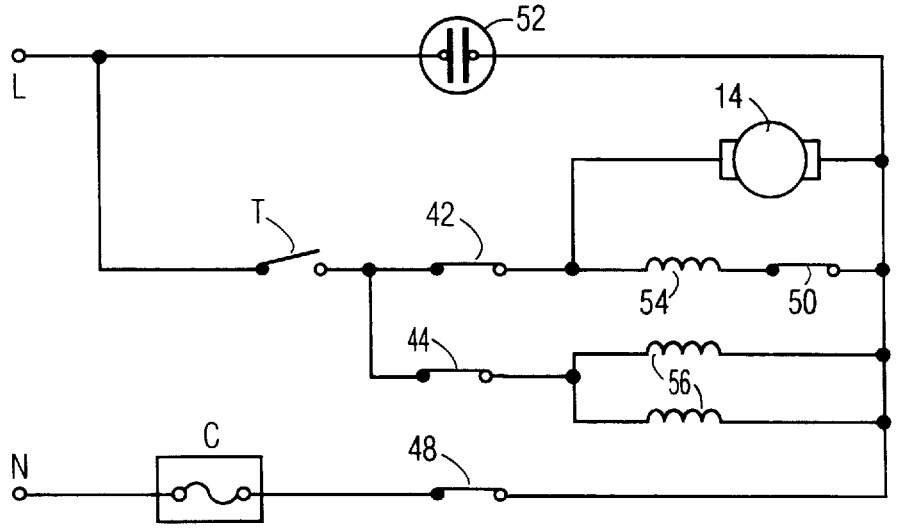
FIG. 7 shows a schematic diagram illustrating the heating mode in Line 4 of FIG. 4 for the embodiment of FIG. 3.

The heating apparatus of FIG. 3 has six modes of operation which are dependent upon the positions of the switches 40–50 in accordance with the table of FIG. 4. In the table the six modes are listed in a vertical column M and each mode has a row defining whether the six switches 40–50 are open (0), closed (1) or don't care (X). Mode 1 provides a cold blowing operation in which the fan motor 14 is activated but neither of the heating elements 54, 56 are activated. Mode 2 provides thermostatically controlled operation of the fan motor 14 and the 1 kW element 54 but not the 2 kW element 56. Mode 3 provides thermostatically controlled operation of the fan motor 14 and the 2 kilowatt element 56 but not the 1 kW element 54. Mode 4 provides thermostatically controlled operation of both the heating elements 54 and 56 to provide a total heat output of 3 kilowatt. This mode is shown in FIG. 7 where the open switches in FIG. 3 have been omitted. Both heating elements 54 and 56 are connected in parallel with the motor 14. Mode 5 provides 'comfort' operation in which the fan motor 14 and the 1 kilowatt element 54 are continually connected to the mains supply and the 2 kilowatt element 56 is thermostatically controlled by the thermostat T. When the thermostat T is closed, the heating elements 54 and 56 are connected in parallel with the motor. This mode provides a substantially constant fan speed but alters the heat output of the fan heater in accordance with requirements. Mode 6 of the fan heater provides 'quiet' operation in which the fan motor 14 is connected in parallel with the 1 kW element 54 and in series with the 2 kilowatt element 56. This is shown in FIG. 6 where the open switches are omitted. This connects the fan motor across approximately two thirds of the supply voltage giving a reduced fan speed and a heat output of approximately 700 W for a 240 V mains supply.

In a practical realisation of a fan heater in accordance with the invention the switches 40 to 50 would conveniently be realised as a set of contacts on a single switch, for example a rotary switch, so that an operator of the heater can easily select the desired mode of operation. Whatever type of switch is used it is vital to ensure that, when changing modes, switch 44 opens before switch 46 closes and vice versa to avoid short-circuiting the mains supply. Further modifications are possible to the fan heater described, for example the thermostat could be arranged to switch between the quiet mode and one of the higher output modes 2, 3 or 4. This provides the heating required with less disturbance to users than fan heaters whose thermostat switches the whole heater on or off. Not only is the disturbance due to the magnitude of the difference between the two states reduced, but since the lower output does still provide some heat, the disturbance due to the frequency of the switching between states should also be reduced.

Figure 5:
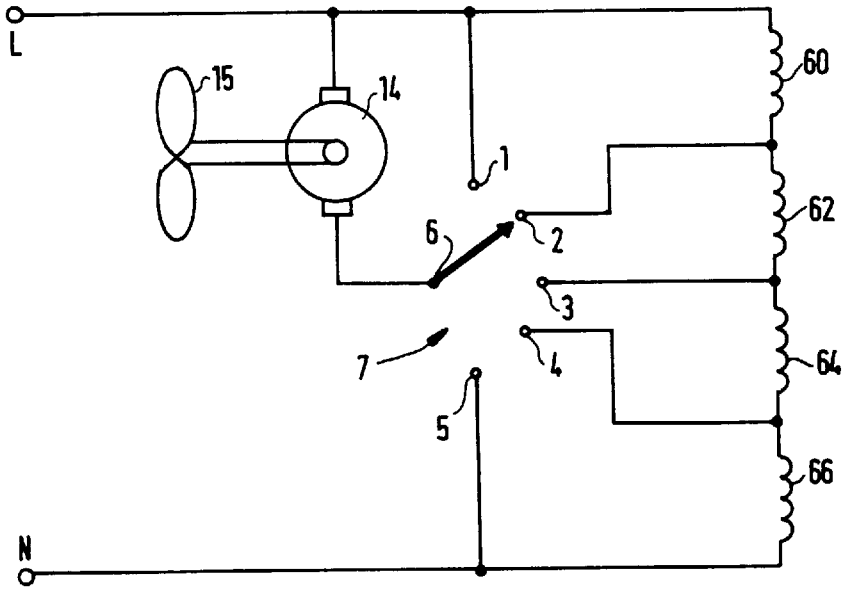
FIG. 5 shows a schematic diagram of a third embodiment of the present invention.

FIG. 5 shows a schematic diagram of another embodiment of the present invention which provides a variety of fan speeds by using a plurality of heating elements wired in series, the fan motor being connected to a supply terminal and any one of a number of taps between the elements. A live terminal of the mains supply is connected to a first terminal of a motor 14, to a first contact 1 of a rotary switch 7 and to a first terminal of a heating element 60. A second terminal of the element 60 is connected to a contact 2 of the switch 7 and to a first terminal of a heating element 62. A second terminal of the heating element 62 is connected to a contact 3 of the switch 7 and to a first terminal of a heating element 64. A second terminal of the heating element 64 is connected to a contact 4 of the switch 7 and to a first terminal of a heating element 66. A second terminal of the heating element 66 is connected to a contact 5 of the switch 7 and to the neutral terminal of the mains supply. A second terminal of the motor 14 is connected to a wiper contact 6 of the switch 7. The wiper contact can be connected to any one of the contacts 1 to 5 by operation of the switch. The motor 14 is connected to drive a fan 15 arranged to blow air over the elements 60 to 66.

When the switch 7 is in position 1 (wiper contact connected to contact 1) the motor 14 is effectively switched off and the heating apparatus functions as a pure convector heater. The physical construction of the apparatus must be such that it will not overheat in this mode as is well known to those skilled in the art. With the switch 7 at position 2 the motor 14 is in parallel with the element 60 and in series with the elements 62, 64 and 66. This provides the slowest fan speed. When the switch 7 is at position 3 the motor 14 is in parallel with the series combination of elements 60, 62 and in series with the elements 64 and 66 which provides a higher fan speed. With the switch 7 at position 4, the motor 14 is in parallel with the series combination of elements 60, 62, 64 and in series with the element 66 which provides a still higher fan speed. In the final position 5 of the switch 7, the motor 14 is connected across the full mains supply to give the fastest fan speed. The heating apparatus in FIG. 5 thus provides a convector heater with fan assistance. The different positions of the switch 7 barely alter the heat output of the apparatus; they only alter the speed at which the heat is distributed to the surrounding air. Where a convector heater is not required, position 1 of the switch 7 may be omitted. The heating elements 60 to 66 may actually be provided by a number of taps on a singly wound heating element. The resistances of the elements 60 to 66 need not be the same but may be chosen to provide a convenient range of fan speeds. The arrangement of FIG. 5 may be incorporated with other series/parallel element arrangements and thermostatic switches to provide a variety of heater characteristics as required.

From reading the present disclosure, other modifications and variations will be apparent to persons skilled in the art. Such modifications and variations may involve other features which are already known in the art and which may be used instead of or in addition to features already described herein. Although claims have been formulated in this application to particular combinations of features, it should be understood that the scope of the disclosure of the present application also includes any novel feature or combination of features disclosed herein either explicitly or implicitly, whether or not relating to the same invention as presently claimed in any claim and whether or not it mitigates any or all of the same technical problems as does the presently claimed invention.

The present invention is particularly applicable to the manufacture of fan heaters for use in domestic, automotive or industrial environments.

We claim:

1. A heating apparatus comprising: a plurality of electrical heating elements, a fan driven by an electric motor and with the fan arranged to drive air past the electrical heating elements, and switching means arranged to provide:

a first heating mode in which a first heating element is connected in parallel with the motor and a second heating element is connected in series with the motor, the heating elements being in series with each other, and a second heating mode in which the first and second heating elements are both connected in parallel with the motor.

2. Apparatus according to claim 1 in which in the second mode the first and second heating elements are connected in parallel with each other.

3. Apparatus according to claim 2 in which the switching means is further arranged to provide a third heating mode in which one of the heating elements is connected in parallel with the motor and the other element is disconnected.

4. Apparatus according to claim 2 further comprising thermostatic means and the switching means is arranged so that in the second heating mode one of the heating elements is controlled by the thermostatic means.

5. Apparatus according to claim 4 in which the switching means comprises an array of six single pole switches and the heating elements are of different thermal value.

6. Apparatus according to claim 1 in which in the second heating mode the first and second heating elements are arranged in series with each other and in parallel with the motor.

7. Apparatus according to claim 6 further comprising a plurality of further heating elements in series with the first and second elements, the switching means being arranged to provide further heating modes in which the further heating elements may be connected consecutively in parallel with the motor.

8. Apparatus according to claim 7 in which the switching means is arranged to provide a final mode in which all heating elements are disconnected.

9. Apparatus according to claim 8 in which the switching means is a five-position rotary switch, the switch contacts being connected respectively to the outer end and the connections between an arrangement of four heating elements in series.

10. The apparatus according to claim 6 further comprising:

a third heating element connected in series with the first and second heating elements to first and second input terminals for connection to a source of supply voltage, wherein the switching means comprise;

a multi-position rotary switch having a wiper terminal coupled to the first input terminal via the motor, a first terminal coupled to the first input terminal and to a first terminal of the first heating element, a second terminal coupled to a junction point between the first and second heating elements, a third terminal coupled to a junction point between the second and third heating elements, and a fourth terminal coupled to the second input terminal and to a further terminal of the third heating element.

11. The apparatus according to claim 1 wherein the switching means is coupled to the first and second heating elements and to the electric motor and further comprising thermostatic means coupled to the switching means so that in at least one of said heating modes at least one of the heating elements is controlled by the thermostatic means.

12. The apparatus according to claim 1 wherein the switching means comprise:

a double pole-double throw switching means having first and second terminals for connection to first and second input terminals for a source of supply voltage, a first wiper terminal coupled to a first terminal of the motor and a second wiper terminal coupled to the first input terminal via the second heating element, and third and fourth terminals connected together, and said heating apparatus further comprises;

means for coupling the first heating element in parallel with the motor, and means for coupling a second terminal of the motor to said second terminal of the double pole-double throw switching means.

13. The apparatus according to claim 1 wherein the switching means comprise:

a first switch coupled between a first input supply terminal and a first terminal of the motor, a second switch coupled between a second input supply terminal and a second terminal of the motor, a third switch connected in series circuit with the first heating element and with said series circuit in parallel with the motor, a fourth switch coupled between the first input supply terminal and the first terminal of the motor, a fifth switch coupling a first terminal of the second heating element to the first input supply terminal, and a sixth switch coupling the first terminal of the second heating element to the second input supply terminal, and means coupling a second terminal of the second heating element to the second terminal of the motor.

14. The apparatus according to claim 13 further comprising a thermostat switch connected between the first input supply terminal and the fourth and fifth switches.

* * * * *